United States Patent [19]

Gilbert et al.

[11] 4,142,725

[45] Mar. 6, 1979

[54] PNEUMATIC GAME WITH FABRIC INTERENGAGING ELEMENTS

[76] Inventors: Bruce R. Gilbert, 1230 N. Flores St., Los Angeles, Calif. 90069; Jack P. Hall, 2306 Manning Ave., Los Angeles, Calif. 90064

[21] Appl. No.: 808,304

[22] Filed: Jun. 20, 1977

[51] Int. Cl.[2] ..... A63F 7/04; A63H 29/16

[52] U.S. Cl. ..... 273/123 A; 273/118 A; 273/129 F; 273/DIG. 30

[58] Field of Search ..... 273/119 B, 95 C, DIG. 30, 273/127 B, 127 R, 1 M, 85 H, 118 R, 116, 1 R, 61 B, 129 F, 123 A, 118 A; 46/DIG. 1, 44

[56] References Cited

U.S. PATENT DOCUMENTS

| | | | |
|---|---|---|---|
| 460,593 | 10/1891 | McConaughy | 273/119 B |
| 464,887 | 12/1891 | McConaughy | 273/119 B |
| 1,653,893 | 12/1927 | Eden | 273/58 A |
| 1,987,695 | 1/1933 | McDonald | 273/1 R |
| 2,470,302 | 5/1949 | Green | 273/127 R |
| 3,391,933 | 7/1968 | Cooper | 46/DIG. 1 |
| 3,601,406 | 8/1971 | Giusti | 46/DIG. 1 |
| 3,927,881 | 12/1975 | Lemelson et al. | 273/DIG. 30 |
| 3,967,824 | 7/1976 | Lund | 273/1 M |
| 4,014,543 | 3/1977 | Arad | 273/129 F |
| 4,045,906 | 9/1977 | Goldfarb et al. | 46/44 |

*Primary Examiner*—Richard C. Pinkham
*Assistant Examiner*—Lawrence E. Anderson
*Attorney, Agent, or Firm*—James E. Brunton

[57] ABSTRACT

A pneumatic game of skill in which a spherical member is propelled by means of a stream of air emitted from a small handheld air motor along a tortuous channel formed in the surface of the game board. The spherical member is covered with a special fabric which, if the member strays off course, causes it to adhere to obstacles located adjacent the channel.

3 Claims, 4 Drawing Figures

12
14
16
16a
18
20
22
24
24a
24b
26
28
30
32
34
36
38
40
42
44
46
48
50
52
54
56
58
2

PNEUMATIC GAME WITH FABRIC INTERENGAGING ELEMENTS

BACKGROUND OF THE INVENTION

1. Field of the Invention

The present invention relates generally to pneumatically operated games of skill. More particularly, the invention concerns a game of skill in which a lightweight spherical member is propelled by a player controlled stream of air through an obstacle course along a tortuous groove or channel formed in the game board of the game.

2. Discussion of the Prior Art

Various types of pneumatic games using spherical members propelled by a controllable stream of air have previously been suggested. Many of these games simulate the sports of football or soccer with the spherical member being maneuvered by the "player" upon a game board which is intended to represent the "playing field." The object of these games generally is to move the ball by controllable streams of air into "goals" provided at the ends or sides of the board. These types of apparatus are primarily concerned with problems of running conduit under the plane of the game board, or playing area and producing a compressed air thrust in response to the activation of some type of triggering mechanism by the player. Typically these types of inventions embody complicated and expensive mechanical, electronical and pneumatic devices which are not only liable to trouble but are complicated to operate.

The apparatus of the present invention provides a totally new and novel type of pneumatic game of skill. While particularly designed for children it is also challenging to adults. The apparatus avoids the drawbacks of similar types of prior art games in that it is uncomplicated, simple to operate and highly durable. The air source is self-contained, easily manipulated by the player and very reliable in operation.

Applicant is familiar with the following prior art patents which represent the most pertinent art known to applicant and which seem to illustrate the novelty of the present invention.

| | |
|---|---|
| 460,592 | 1,850,715 |
| 460,593 | 2,582,844 |
| 1,144,112 | 3,038,725 |
| 1,231,251 | 3,771,789 |

SUMMARY OF THE INVENTION

An object of the invention is to provide a unique and highly entertaining pneumatic game of skill in which a light weight ball is propelled by a controllable stream of air through an obstacle course formed on the surface of the game board. The ball is covered with a special fabric which, if the ball moves off course, will cause it to adhere to various objects located proximate a channel formed in the board along which the ball travels.

Another object is to provide a game of the aforementioned character in which the game board is visually appealing, but at the same time is sturdy and durable. For example, the game board may simulate the desert terrain of the great American Southwest with the obstacles being provided in the form of geological formations, vegetation, buildings and random artifacts modelled after their actual counterparts in the Mojave and Sonora deserts.

Another object is to provide a game of the type described in which there is included a timer of simple design adapted to visually provide a measure of time during which the ball is to be moved through the obstacle course.

It is a further object to provide a game of the character described which is of simple construction, which embodies standard, readily available materials and which can be inexpensively mass produced.

In summary these and other objects of the invention are achieved by a pneumatic game comprising in combination; a game board providing a substantially planar surface having formed within an elongated, tortuous raceway; a plurality of objects affixed to said planar surface in close proximity with said tortuous raceway, each of said objects exhibiting at least one surface facing said raceway and having a multiplicity of outwardly protruding interengaging means; a substantially spherically shaped member exhibiting an outer surface having a multiplicity of outwardly protruding interengaging means adapted to disengageably interlock with said interengaging means provided on said surface of said objects, said members being configured to rollably engage said raceway; and impeller means for producing a collimated stream of air which can be directed against said spherical member to propel it along said raceway.

BRIEF DESCRIPTION OF THE INVENTION

DESCRIPTION OF ONE FORM OF THE INVENTION

Figures 1, 2, 3, 4:
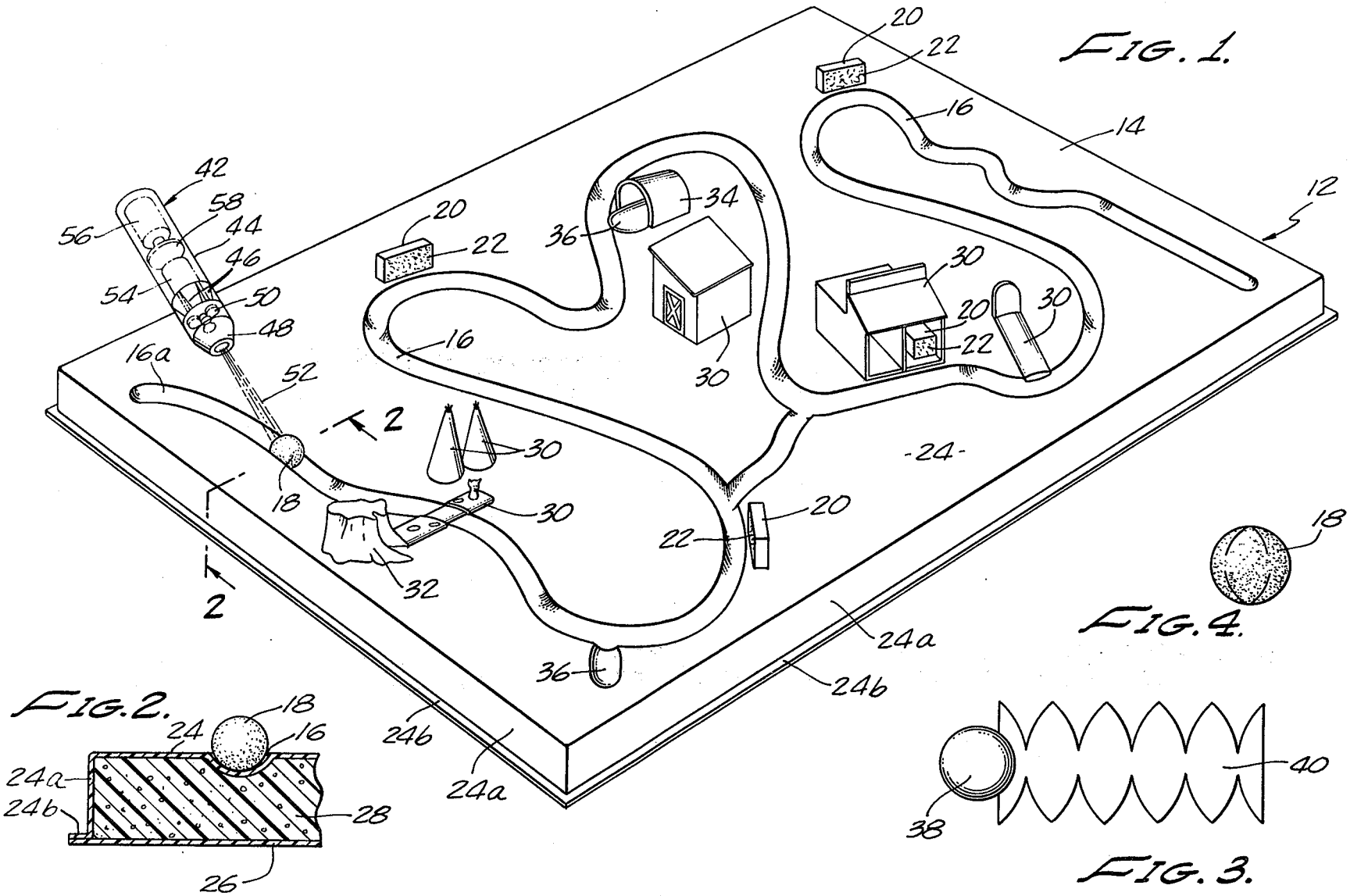
FIG. 1 is a generally perspective view of the pneumatic game of the invention.
FIG. 2 is an enlarged fragmentary cross-sectional view taken along lines 2—2 of FIG. 1.
FIG. 3 is a plan view illustrating the Mercator projection configuration into which the fabric material that covers the hollow sphere of the game is cut.
FIG. 4 is a perspective view showing the appearance of the sphere after the fabric has been bonded thereto.

Referring to the drawings and particularly to FIG. 1, the pneumatic game of the invention comprises a game board 12 providing a substantially planar surface 14 having formed therein an elongated tortuous raceway 16. As best seen by referring to FIG. 2, raceway 16 is substantially semicircular in cross section and functions as a guideway for the passage of thin-walled, fabric-covered hollow sphere 18.

Positioned upon planar surface 14 is a plurality of objects generally indicated by the numeral 20, each of which is disposed in close proximity with raceway 16 at various locations along its length. As shown in FIG. 1 each object 20 is provided with at least one surface which faces the raceway and has affixed thereto a fabric material 22.

Game board 12 may be constructed of a variety of materials such as wood, metal, or plastic. In the form of the invention shown in the drawings, the game board is constructed of a preformed top member 24 and a bottom closure member 26. Member 24 is formed of a polystyrene or like plastic material which is blow-molded or vacuum formed into the desired configuration.

As best seen in FIG. 2, top member 24 has side walls **24*a* each having an outturned flange portion 24*b*. Bottom member 26 is substantially flat and is affixed to flanges 24*a* of member 24 by any suitable means such as solvent bonding. To add strength and rigidity to the game board, the space intermediate top and bottom members 24 and 26 is filled with a urethane foam 28 or similar plastic substitute. Although the urethane may be formed separately in a mold it is preferably foamed in place within the game board after top and bottom wall 24 and 26** have been bonded together.

In addition to objects 20, various other objects in the shape of structures 30, rocks 32 and caves 34 are positioned at various locations on the planar surface of the game board. These objects carry out the decorative scheme of the game and may be molded integrally with top wall 24 or may be formed separately and attached to the board as by solvent bonding. Also formed on top wall 24 are spaced apart depressions 36, the purpose of which will presently be described.

Turning now to FIGS. 3 and 4, previously mentioned sphere 18 comprises a thin-walled hollow member 38 (FIG. 3) which is covered with a fabric material 40. This material, which exhibits a multiplicity of second interengaging means is adapted to disengageably interlock with fabric material 22 which exhibits first interengaging means. While various fabric materials or other adhesive materials as, for example, magnetic materials, can be used to cover the faces of objects 20 and the outer surface of member 38, a material sold under the trademark Velcro has been found quite satisfactory. This material is characterized as being in one form hook-textured, e.g., exhibiting a multiplicity of tiny outwardly protruding loops. When the two forms of the material are pressed into engagement, the hook-like protrusions will disengageably interlock with the loop-shaped protrusions, thereby disengageably joining the two pieces of fabric.

As illustrated in FIG. 3, in forming sphere 18 the fabric 40 is cut in the form of a Mercator projection and then bonded to the outer wall of the hollow sphere 38 to form the fabric-covered sphere 18 shown in FIG. 1, 2 and 4.

As will be discussed in greater detail in the paragraphs which follow, the object of the pneumatic game of the present invention is to move sphere 18 along the length of raceway 16 by means of a stream of air emanating from an impeller means. In the embodiment of the invention illustrated in the drawings, the impeller means is provided in the form of handheld blower 42 (FIG. 1). Blower 42 comprises a generally cylindrically shaped hollow housing 44 having a series of circumferentially spaced openings 46 defining an air inlet and a forwardly extending air outlet nozzle 48. Rotatably mounted within housing 44 intermediate the air inlet and air outlet is a propeller means 50 for drawing air into the housing through air inlet 46 and ejecting it through air outlet nozzle 48. Nozzle 48 is constructed so as to produce a collimated stream of air 52 which may be directed through manipulation of blower 42. Propeller 50 is of a standard three-blade design and is connected to the shaft of a small electrical motor 54 which is carried within housing 44. Motor 54 is of standard design and is adapted to be driven by one or more dry cell batteries 56, also carried within housing 44. A switch 58 of standard design is interposed between motor 54 and battery 56 to enable selective energization of the motor. Motor 54, battery 56 and switch 58 are commercially available and are of standard design. Their interconnection is well understood by those skilled in the art and will not be discussed in detail herein. Housing 44 may be constructed of a wide variety of materials such as wood, metal, or plastic. In the embodiment of the invention shown in FIG. 1 the housing is formed from a plastic such as polyethylene.

In playing the game of the present invention the sphere 18, which in the game board motif here illustrated, represents a "tumbleweed," is first placed within raceway 16 proximate its forward end 16*a*. Blower 42 is then grasped by the player and motor 54 is energized by means of switch 58. This causes propeller 50 to rotate and a collimated stream of air to be emitted from the device. The stream of air 52, although not of high velocity, when directed at the sphere will cause the latter to roll along raceway 16. The speed at which the sphere will travel along the raceway depends upon the distance between the blower and the sphere and the angle to which the stream of air strikes the sphere. The object of the game is to carefully maneuver the sphere 18 along the raceway in a manner so as to prevent its jumping from the raceway, falling into depressions 36, or adhering to the fabric swatches 22 which are affixed to objects 20. If the player moves the sphere along the raceway too rapidly, the sphere will strike an object 20 and the interengaging means of the fabric covering will disengageably interlock with the interengaging means in the "velcro" surface on the fabric swatches 22. Once the "tumbleweed" has stuck to the "velcro" swatch attached to an object 20, the resulting bond will be sufficiently strong to resist disengagement as a result of the low velocity stream of air emitted from the blower. The "tumbleweed," therefore, must be detached from the objects 20 by hand.

In playing the game a timer can be used with the object being to move the sphere along the entire length of the raceway in a minimum time. Alternatively a scoring system can be devised whereby points are lost should the sphere become entrapped in a depression 36 or become affixed to object 20.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A pneumatic game comprising in combination:

(a) a game board providing a substantially planar surface having formed therein in an elongated, tortuous raceway:

(b) a plurality of objects affixed to said planar surface in close proximity with said tortuous raceway, each of said objects exhibiting at least one surface facing said raceway and comprising a fabric material having a multiplicity of outwardly protruding interengaging means;

(c) a substantially spherically shaped member exhibiting an outer surface having a multiplicity of outwardly protruding interengaging means adapted to disengageably interlock with said interengaging means provided on said surface of said objects, one of said interengaging means provided on said surface of said objects and said surface of said spherically shaped member being hook-textured and the other of said surfaces being loop textured, said member being configured to rollably engage said raceway; and (d) impeller means for producing a collimated stream of air which can be directed against said spherical member to propel it along said raceway, said impeller means comprising:

(1) a hand held, hollow housing having an air inlet and a forwardly extending air outlet nozzle;

(2) a propeller means rotatably mounted within said housing intermediate said air inlet and said air outlet nozzle for drawing air into said housing through said air inlet and ejecting it through said air outlet nozzle; and (3) means for rotating said propeller.

2. A pneumatic game comprising in combination:

(a) A game board having a substantially planar surface and providing an elongated, tortuous raceway;

(b) A plurality of objects affixed to said planar surface in close proximity with said tortuous raceway, each of said objects exhibiting at least one surface facing said raceway having a fabric material affixed thereto, said material exhibiting first interengaging means;

(c) A thin-walled hollow sphere covered with a fabric material having second interengaging means adapted to disengageably interlock with said first interengaging means, said member being configured to rollably engage said raceway; and (d) Impeller means for producing a collimated stream of air which can be directed against said spherical member to propel it along said raceway, said impeller means comprising:

(a) A hand held, hollow housing having an air inlet and a forwardly extending air outlet nozzle;

(b) A propeller means rotatably mounted within said housing intermediate said air inlet and said air outlet nozzle for drawing air into said housing through said air inlet and ejecting it through said air outlet nozzle; and (c) Means for rotating said propeller.

3. A pneumatic game as defined in claim 2 in which one of said first or second interengaging means is hook-textured and the other is loop-textured.

* * * * *